US006540374B2

(12) United States Patent
Kira et al.

(10) Patent No.: US 6,540,374 B2
(45) Date of Patent: Apr. 1, 2003

(54) IN-GROUND OR IMPROVED WELL LIGHT

(75) Inventors: Hiroshi Kira, Camarillo, CA (US); Allan Cameron, Natick, MA (US); John Wadsworth, Westlake Village, CA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 09/945,307

(22) Filed: Aug. 30, 2001

(65) Prior Publication Data

US 2002/0044443 A1 Apr. 18, 2002

Related U.S. Application Data

(60) Provisional application No. 60/226,845, filed on Aug. 31, 2000.

(51) Int. Cl.[7] ..... E01F 9/00

(52) U.S. Cl. ..... 362/153.1; 362/269; 362/285; 362/427; 362/375

(58) Field of Search ..... 362/153, 153.1, 362/285, 269, 271, 277, 286, 267, 158, 164, 427, 428, 372, 374, 375

(56) References Cited

U.S. PATENT DOCUMENTS 5,481,443 A * 1/1996 Wagner et al. ..... 362/153.1
5,887,966 A * 3/1999 Eissner et al. ..... 362/153.1
5,908,236 A * 6/1999 Lueken et al. ..... 362/153

* cited by examiner

*Primary Examiner*—Sandra O'Shea
*Assistant Examiner*—John Anthony Ward
(74) *Attorney, Agent, or Firm*—John E. Wagner

(57) ABSTRACT

An in-ground light fixture is disclosed having multiple separate and watertight compartments for the various components of the fixture, allowing for maintenance and service of the fixture without exposing weather-sensitive components to the elements. The fixture also includes a pan and tilt assembly, which can be selectively controlled with a common household tool to change the direction of the light without having to access the pan and tilt assembly.

29 Claims, 13 Drawing Sheets

IN-GROUND OR IMPROVED WELL LIGHT

REFERENCE TO RELATED APPLICATION

This non-application claims benefit of U.S. Provisional Application Ser. No. 60/229,845 filed Aug. 31, 2000, and hereby claims the benefit of the embodiments therein and of the filing date thereof.

BACKGROUND OF THE INVENTION

Sub-surface lighting fixtures, such as in-ground or submerged well lights, are among the most dramatic and beautiful means of highlighting a specific feature or area of a property. In-ground lighting fixtures of this invention are designed for either flush mount concrete or masonry installation and the like or flush mount soil installation.

In the field of outdoor lighting fixtures, there is no greater challenge than to design an in-ground or well lighting fixture. In-ground lighting fixtures are constantly being subjected to the elements, specifically the affects of heat, cold, rain, sun, ice, wind, dirt, and debris.

Additionally, in-ground lighting fixtures are subject to damage from lawn chemicals, passersby, vehicles of all types, maintenance and service personnel and their equipment, animals, as well as the surrounding vegetation. The most damaging of all is perhaps, moisture from any source, e.g., rain, snow, dew, humidity, or lawn sprinklers.

In other instances, in-ground lighting fixtures, which are installed prior to construction, may be damaged during the completion of the construction, e.g., the in-ground fixture is installed, prior to pouring the concrete or asphalt patio, walk or driveway.

In still other cases, the in-ground or well lighting fixture is installed prior to landscaping and damage may occur during completion of the landscaping.

During and after installation of an in-ground or well light fixture, the fixture is subject to inspection, maintenance, and possibly repair; however, each is made more difficult after installation has been completed. In the case of submerged fixtures, there is a very real danger of leakage into the fixture after maintenance or relamping.

Given each of the above challenges, many have attempted to develop an effective, reliable, durable, and user friendly in-ground fixture, but have been unable to meet all of these challenges in a single style fixture. Clearly, there exists a need to design a lighting fixture which can withstand these conditions and environmental extremes.

BRIEF SUMMARY OF THE INVENTION

Faced with this state of the art, it is a general object of this invention to improve the effectiveness and reliability of in-ground or well light fixtures.

Further objects of this invention are to provide:

1. a watertight exterior housing compartment, which keeps water and debris out of the fixture; and supports a lamp housing, a ballast housing and a wiring compartment, each housing being sealed from each other and from the environment;
2. a lamp housing within the exterior housing with a rugged, tempered glass lens, which is fully sealed and the fixture may be relamped in the field or the lamp housing removed for relamping elsewhere;
3. a fully sealed ballast housing within the exterior housing;
4. an easy to operate aiming mechanism for panning, tilting and locking the fixture's beam pattern using only a common household tool without having to remove the lamp housing;
5. a fixture, which is adaptable to the most popular lamp choices;
6. a wiring compartment that is separate, water tight and sealed from the rest of the fixture and which is easily accessible from the outside for inspection or maintenance without having to enter to the ballast housing, lamp housing or exterior housing;
7. an exterior housing and wiring compartment which may be installed and sealed during construction permitting the remaining components to be installed at a later date.

Other objects and advantages will become apparent from consideration of the following description taken in connection with the drawings.

BRIEF DESCRIPTION OF THE DRAWINGS

This invention may be more clearly understood with the following detailed description and by reference to the drawings in which.

DETAILED DESCRIPTION OF THE INVENTION

Figure 1:
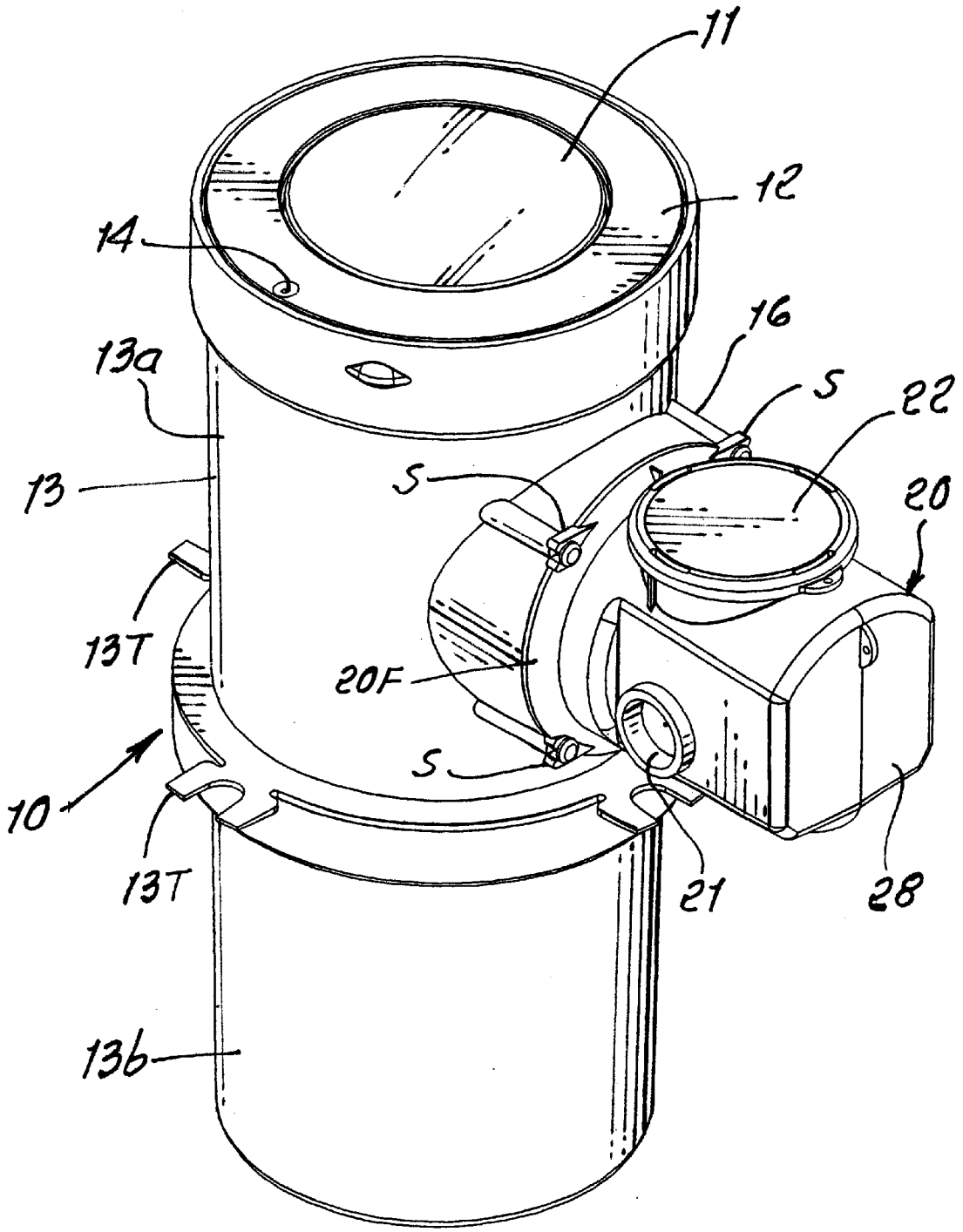
FIG. 1 is a perspective view of an in-ground or well light incorporating this invention.

The in-ground or well light fixture of this invention, generally designated 10, is shown in FIG. 1.

The fixture 10 of this invention, with its light-emitting lens 11 and trim ring 12, is generally enclosed by a cylindrical exterior housing member 13, which is made of a UV stabilized corrosive resistant polycarbonate, as described in *Modern Plastics* 1998 *Encyclopedia*, pages B-56 through B-57, and commonly sold under the G. E. Plastics trademark LEXAN. The exterior housing 13 is designed for flush-mount installation and is strong enough to withstand drive-overs by vehicles weighing up to 5,000 pounds.

Figure 13:
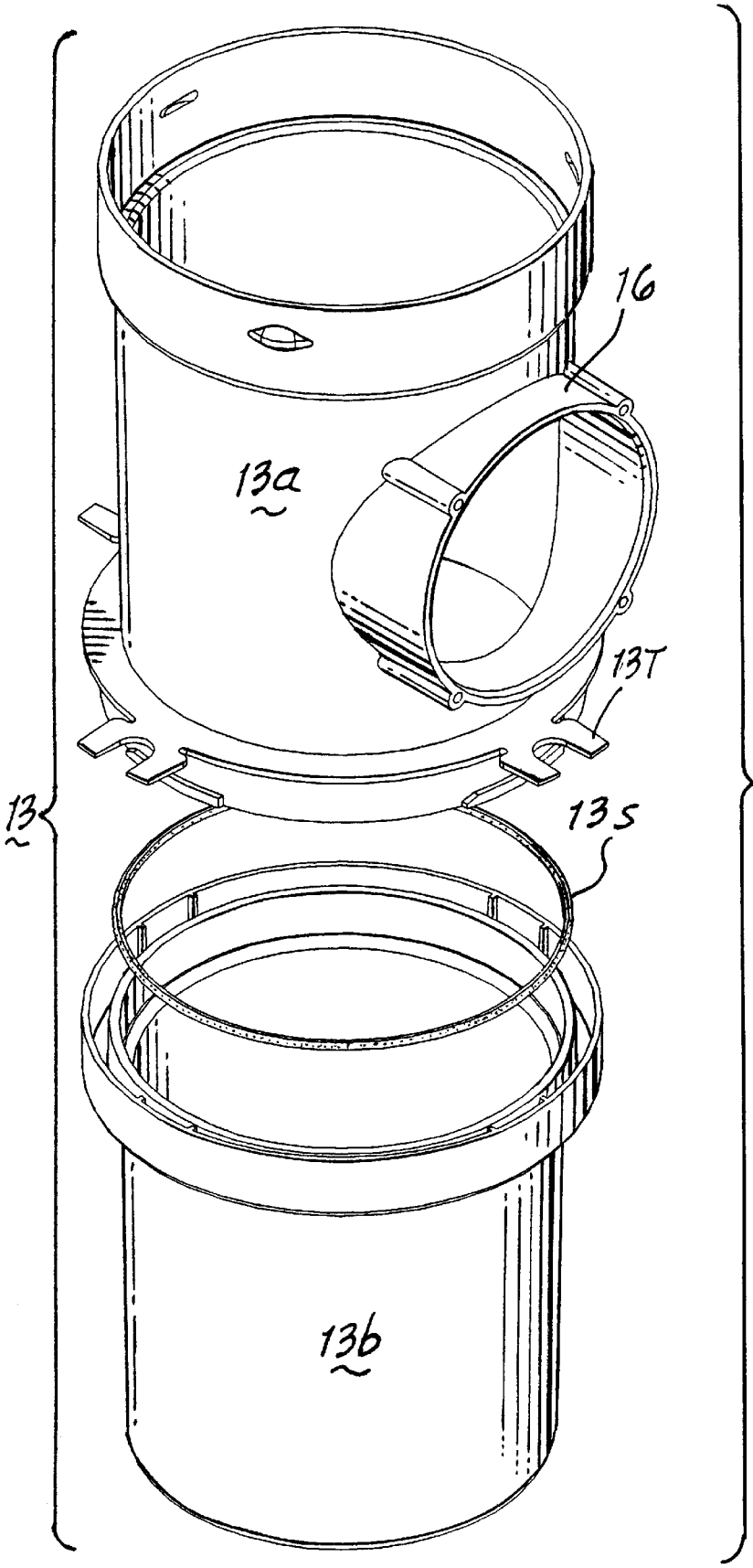
FIG. 13 is an exploded perspective view of the two-piece bucket subassembly of the fixture of FIG. 1.

The exterior housing member 13 is molded in two parts, an upper housing member 13*a* and a lower housing member 13*b*, both of which can be see more clearly in FIG. 13. The upper housing member 13*a* and lower housing member 13*b* are joined together by a screw wedge lock and seal better shown and described below in connection with FIG. 13.

The upper housing member 13*a* also includes several forked tabs 13T, which extend outward from the housing member 13*a*, for securing the housing 13 to reinforcement bars (not shown) where the fixture is installed in, for example, concrete. In the case of in-soil installation, the tabs 13T serve to stabilize the fixture within the soil.

At the top end of the upper housing member 13*a*, opposite its connection with the lower housing member 13*b*, is the fixture's light-emitting lens 11 which is enclosed in water-tight fashion to the upper housing member 13*a* by a trim ring 12, attached by a single screw fastener 14 and an internal locking tab, opposite the screw fastener 14, not shown in FIG. 1.

The upper housing member 13*a* also includes a side manifold 16 for receiving a wiring box subassembly 20, which is generally cylindrical and is secured to the upper housing member 13*a* at its flange 20F by a plurality of screws S, three of which appear in FIG. 1.

The wiring box or electrical housing 28, as shown in FIG. 1, includes a power in receptacle 21 for the fixture's lead in electrical wiring, an external wiring and inspection port 22, as well as several wiring punch-outs (not shown) for alternate wiring lead-in positions.

Figure 2:
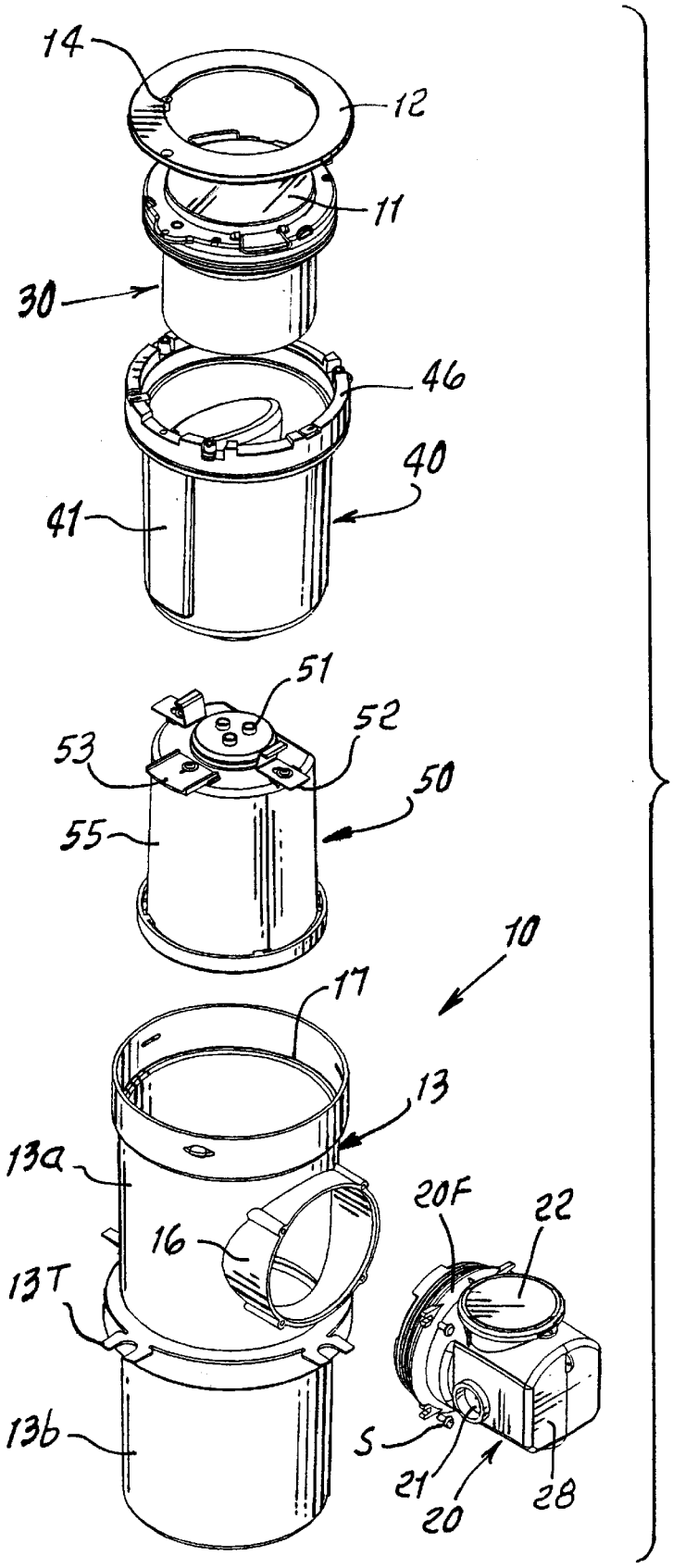
FIG. 2 is an exploded view of the invention of FIG. 1.
Figure 5:
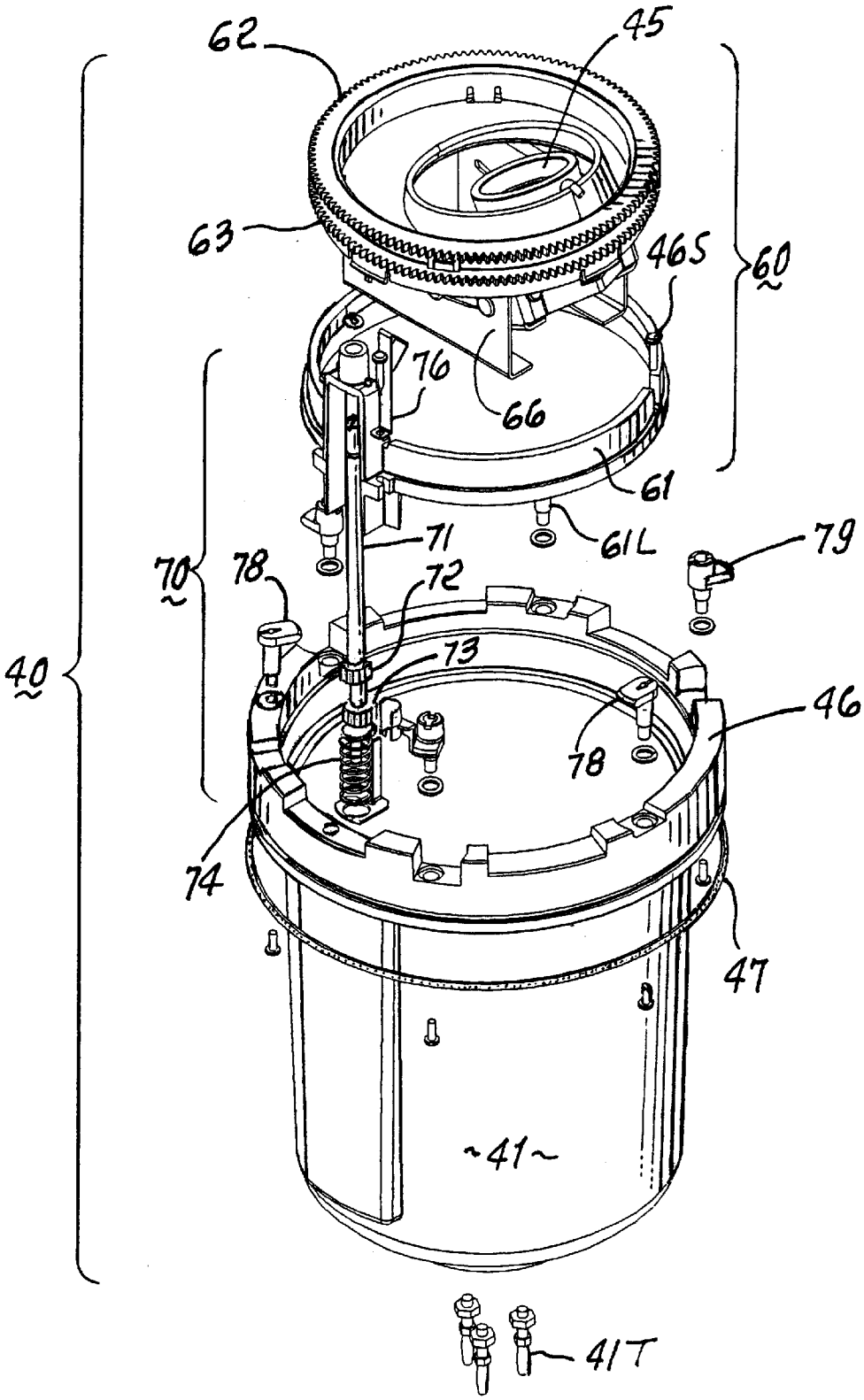
FIG. 5 is an exploded perspective view of the lamp housing of FIGS. 2 and 3 showing the pan and tilt head subassembly of the fixture.

The light fixture 10, in addition to the housing 13 and wiring box subassembly 20, is comprised of several subassemblies shown in FIG. 2: a ballast subassembly 50, a lamp subassembly 40, a pan and tilt subassembly 60 of FIG. 5, a lens subassembly 30, and a pinion subassembly 70 of FIG. 5.

FIG. 2 also illustrates the fixture's upper housing member 13*a*, lower housing member 13*b*, generally discussed above.

The ballast subassembly 50 contains a ballast and other electrical components depending upon the type of lamp used and is enclosed by the generally cylindrical ballast housing 55 and is designed to fit within the lower housing member 13*b*. The ballast subassembly 50 is watertight and sealed from the fixture's other subassemblies as well as from the exterior housing 13. The ballast housing 55 is made of a UV corrosive resistant polycarbonate commonly sold under the G. E. Plastics trademark LEXAN, as described above, and has two ballast hooks 52, one ballast tab 53, and three electrical sockets 51, which are attached to the top portion of the ballast housing 55, and each are described in more detail in connection with FIGS. 11 and 12 below.

The lamp subassembly 40 comprising a pan and tilt subassembly 60, best seen in FIGS. 3, and 5–7, and a pinion subassembly 70 of FIG. 5 is enclosed by a generally cylindrical lamp house 41. The lamp house 41 may be made of LEXAN, described above, and is designed to fit within the upper housing member 13*a*. The lamp house 41 supports and partially encloses the pan and tilt assembly 60 and the lens assembly 30.

The lens assembly 30 is configured to fit within the lamp house 41 and partially enclose the pan and tilt assembly 60 and pinion subassembly 70 (FIG. 5). Trim ring 12 covers the lens assembly 30 in watertight fashion, and attaches to the lamp house 41 to complete the fixture, as shown in FIG. 2.

Figure 4:
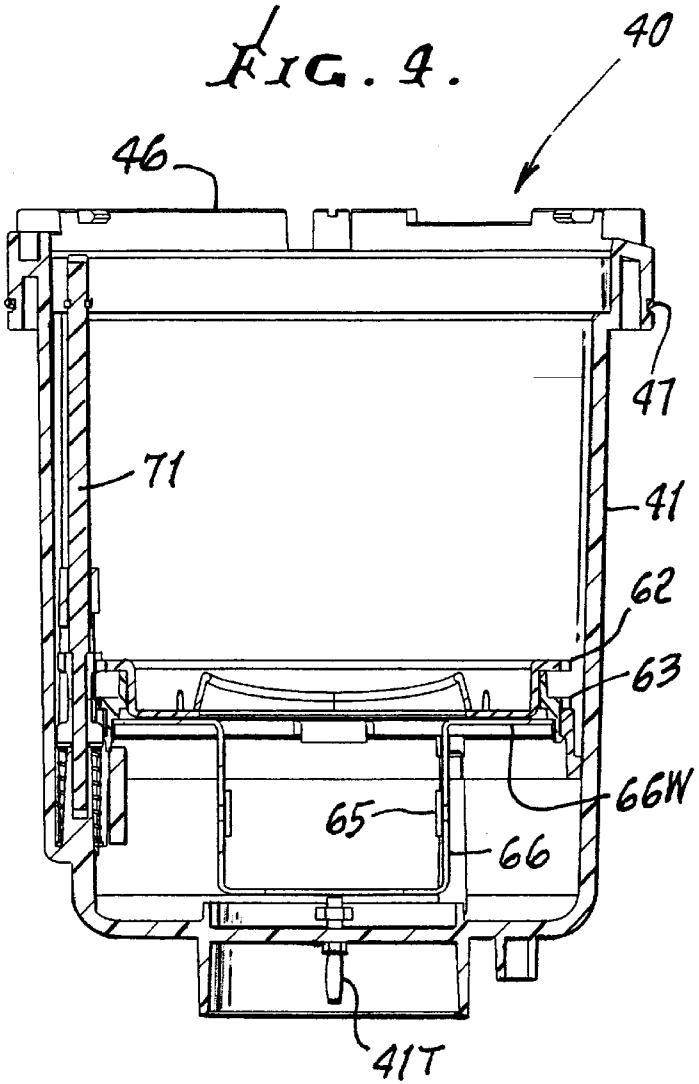
FIG. 4 is a vertical sectional view of the lamp housing subassembly of FIG. 1 taken along an axis orthogonal to the section of FIG. 3.
Figure 3:
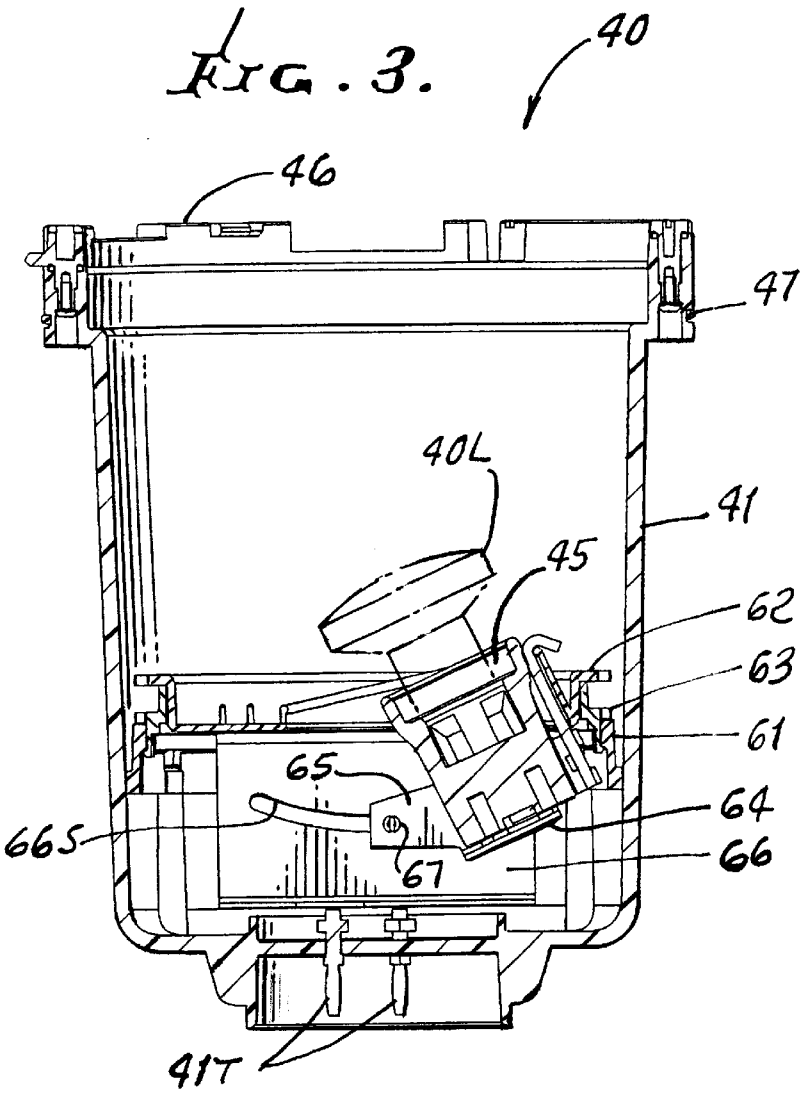
FIG. 3 is a vertical sectional view of the lamp housing subassembly of the fixture of FIG. 2, with a lamp shown in phantom.

Referring now generally to FIGS. 3, 4, and specifically to FIG. 5, which illustrate the lamp subassembly 40 including the pan and tilt subassembly. 60 and pinion subassembly 70, the pan and tilt subassembly 60 and pinion subassembly 70 are designed to fit within and be supported by the lamp house 41. The pan and tilt subassembly 60 rests upon the interior base of the lamp house 41 and is attached thereto.

The pan and tilt subassembly 60 is comprised of a lamp socket 45, a cylindrical tilt gear 62, engaged with and lying on top of a cylindrical pan gear 63, all of which are supported by a pan and tilt track 66. The pan and tilt subassembly 60 is described in greater detail in conjunction with FIGS. 6, 7 and 8.

The lamp house 41, best seen in FIGS. 2–4, is generally cylindrical in configuration with one end closed. At its open end, the lamp house 41 has a lip 46, which extends outward and away from the main body of the lamp housing 41. The lip 46 is designed to engage and be supported by upper housing member 13*a* at its ridge 17, which extends inward from the interior portion of the upper housing member 13*a*. An O-ring 47 seals the lip 46 and ridge 17.

The lip 46 of the lamp housing 41 has a flattened top portion, which holds several tab locks, one of which is the lens lock 78, two of which are shown in FIG. 5, and the other being the lamp lock 79, one of which is shown in FIG. 5. The tab locks 78 and 79 are described in detail in conjunction with FIGS. 9 and 10 below.

Figure 11:
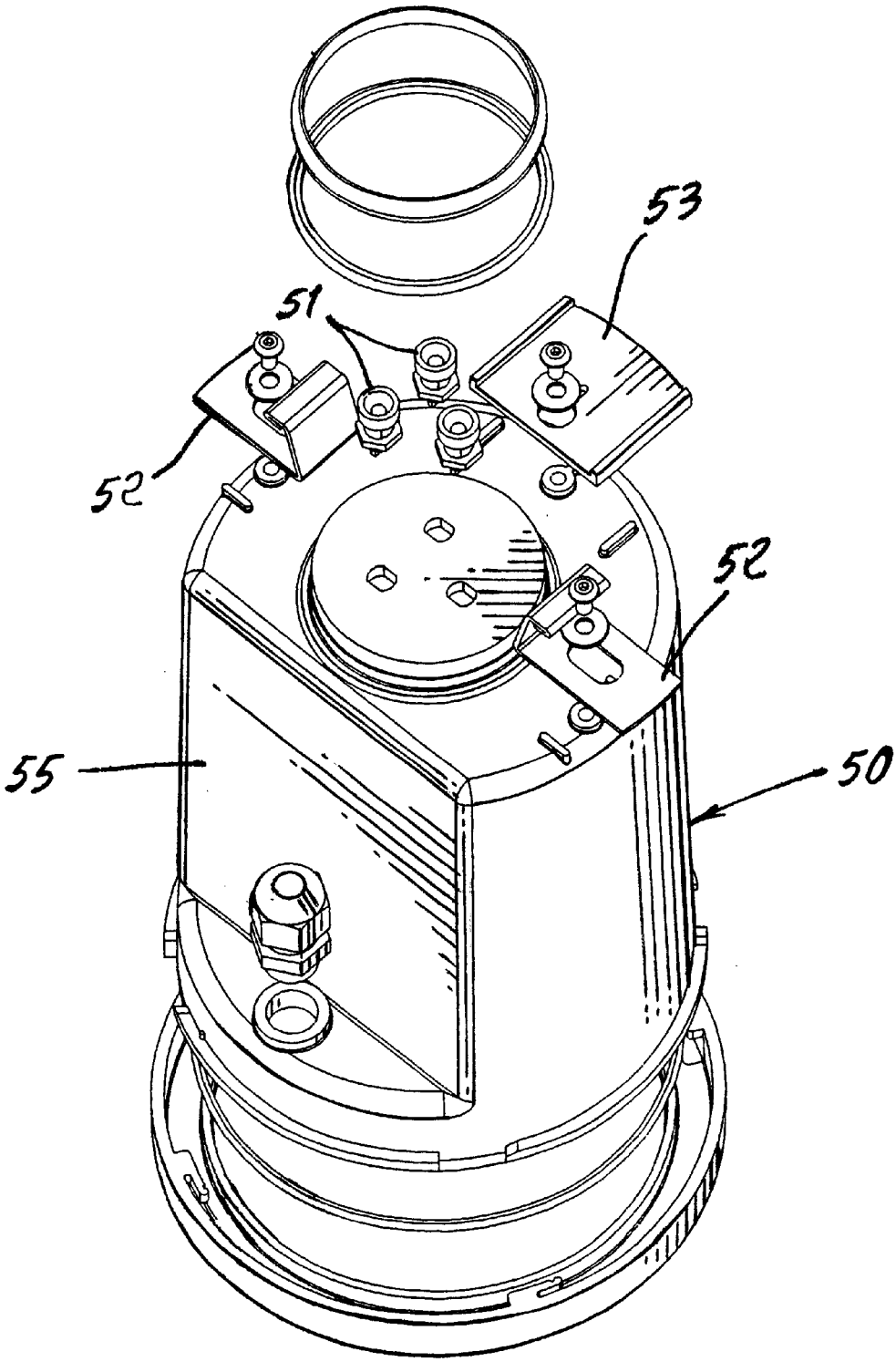
FIG. 11 is a perspective underside view of the ballast assembly of the fixture of FIG. 2.

At the exterior portion of the closed end of the lamp housing 41, as shown in FIGS. 3 and 4, are three electrical connection pins 41T, which are configured to be received by three electrical connection sockets 51 attached to the exterior top portion of the ballast housing 55, as shown in FIG. 11.

A pan and tilt retainer 61 of FIG. 5 has a number of legs 61L, one of which is shown in FIG. 5, which extend away from of the retainer 61 and are designed to be received by the flat portion of the lamp housing lip 46 in a press fit engagement. The pan and tilt retainer 61 is further secured to the lamp housing lip 46 by pinhead screws 46S, one which is shown in FIG. 5. Also connected to the pan and tilt retainer 61 is the pinion subassembly 70.

The pan and tilt subassembly 60 is .operated by the pinion subassembly 70. At the top end of the pinion shaft 71, the shaft 71 attaches to the pan and tilt retainer 61. A pan and tilt stop 76 is also located at the top end of the pinion shaft 71. At the lower end of the pinion shaft 71 is the pinion spring 74, upon which the shaft 71 rests and is biased upward. Just above the spring 74 on the pinion shaft 71 are two gears; a tilt spur gear 72 and a pan spur gear 73, which engage tilt gear 62 and the pan gear 63 when the pinion shaft 71 is properly engaged and rotated.

The pinion subassembly 70 is biased to normally engage the pan gear 62. To engage the pan gear 62, all that is needed is a standard screwdriver, which fits into the top of the pinion shaft 71. Turning the screwdriver orients the pan gear 62.

To engage the tilt gear 63, the pinion shaft 71 is depressed by a screwdriver or the like. When the pinion shaft 71 is depressed to engage the tilt gear 63, the pan gear 62 is automatically locked into place. Removing the screwdriver sets and locks both the pan gear 62 and tilt gear 63.

The top portion of the pinion shaft 71, which engages the screwdriver or the like, is not covered by the lens subassembly 30 when in place in the fixture 10. This allows for the manipulation of the pan and tilt without having to remove the lens subassembly 30. To access the pinion shaft 71, all that is required is to remove the trim ring 12 to expose the top of the pinion shaft 71.

Figure 6:
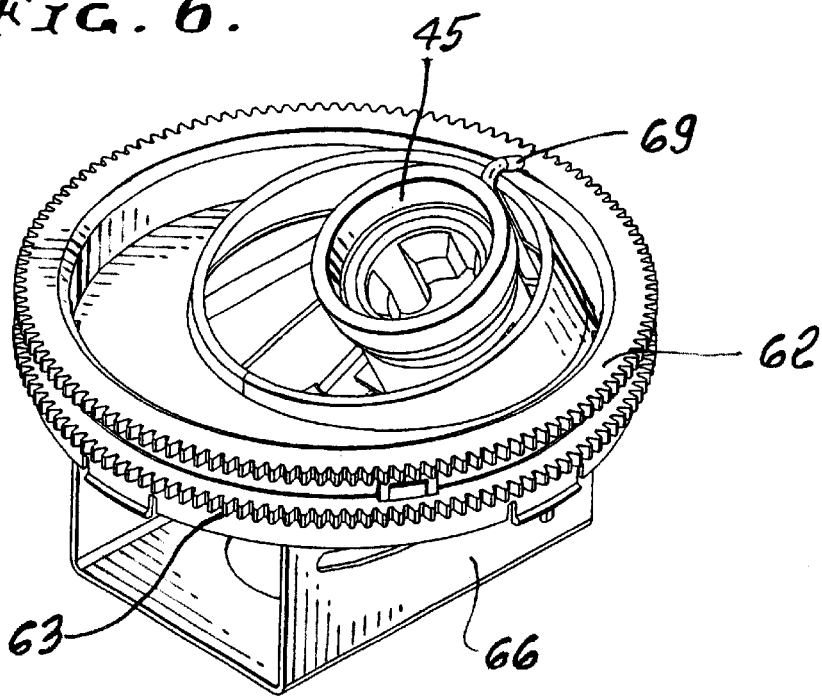
FIG. 6 is a perspective view of the upper side of the pan and tilt subassembly of FIGS. 2, 3 and 5.
Figure 7:
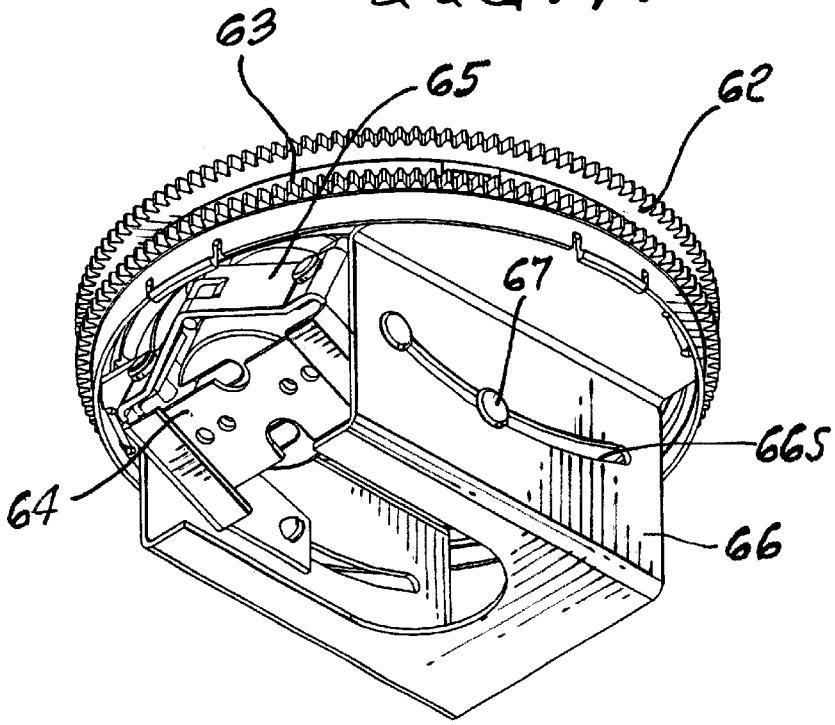
FIG. 7 is a perspective view of the underside of the pan and tilt subassembly of FIGS. 2, 3 and 5.
Figure 8:
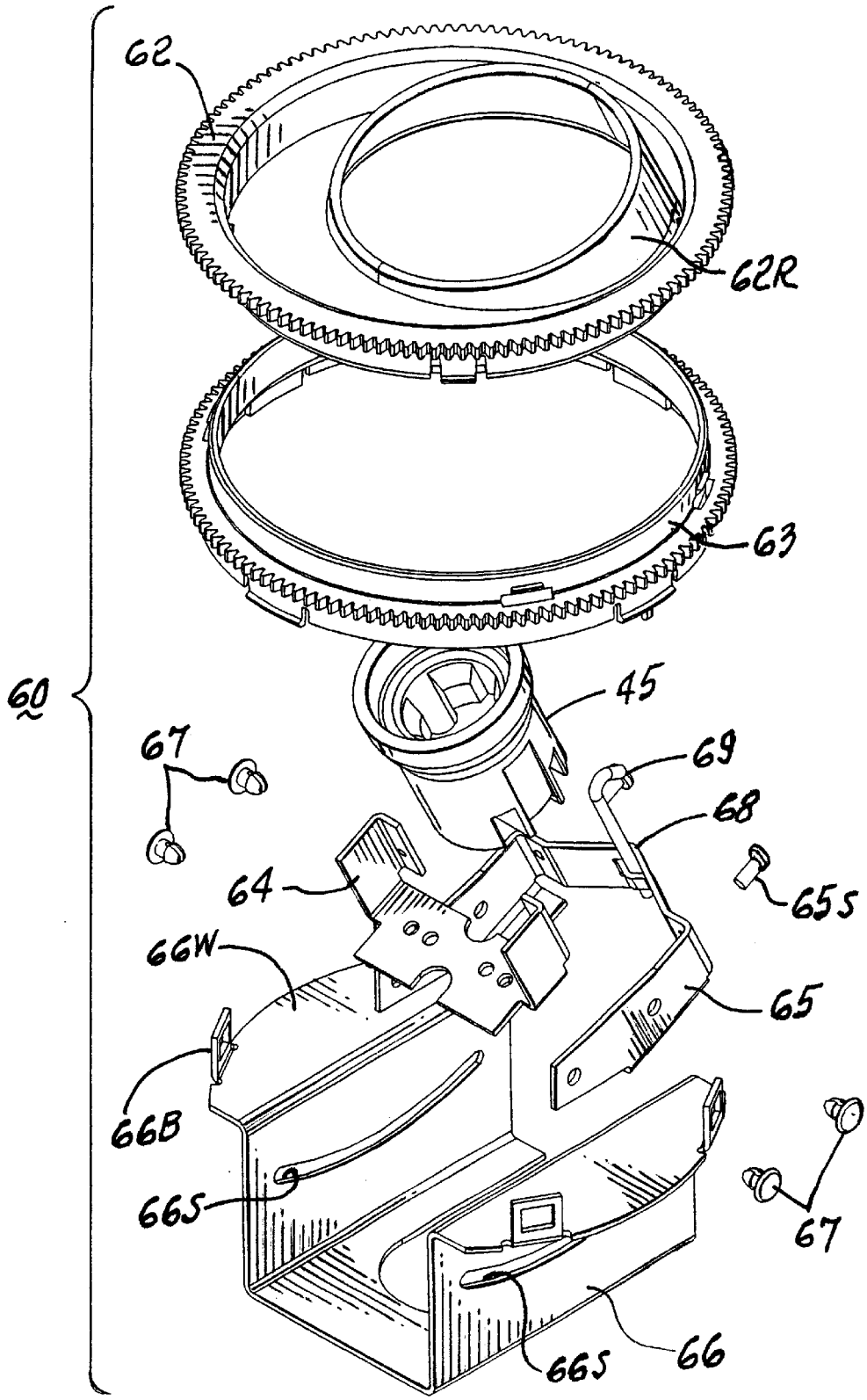
FIG. 8 is an exploded perspective view of the pan and tilt subassembly of FIGS. 2, 3, 5, 6, and 7.

FIGS. 6, 7 and 8 illustrate the pan and tilt assembly 60 in detail. At the center of the pan and tilt assembly 60 is the lamp socket 45. The lamp socket 45 is configured to be received and held in place by the socket mount 64.

The socket mount 64 is U-shaped with a base having two legs which extend away from the base. The bottom portion of the socket 45 rests against the base of the socket mount 64, while the legs of the socket mount 64 receive the sides of the socket 45 and hold it firmly. The socket mount 64 is attached to a pan and tilt carriage 65 by a pair of rivets 65S, one of which is shown in FIG. 8.

The pan and tilt carriage 65 is also generally U-shaped, with a base and two legs, which are parallel to each other and extend away from the base. The base of the pan and tilt carriage 65, at its center, is angled so as to form an apex 68. The apex supports a J-hook 69, which extends at an angle away from the base of the pan and tilt carriage 65 at or about the same angle as the socket 45. The J-hook 69 is designed to hook onto and ride along the raised center portion 62R of the tilt gear 62 through which the lamp and lamp socket 45 are positioned, as seen more clearly in FIG. 6.

The pan and tilt track 66 is generally U-shaped with two legs which are parallel and extend away from the base. The pan and tilt track 66 is attached to the bottom interior portion of the lamp house 41, as seen in FIGS. 3 and 4. The pan and tilt track legs 66 each have identical arcuate openings or slits 66S.

The pan and tilt carriage 65 is movably attached to the pan and tilt track 66 by four snap fasteners 67 attached through the slots 66S of the pan and tilt track legs 66, such that the pan and tilt carriage 65 may freely move along the pan and tilt track slots 66S, when activated by the pinion shaft 71.

The tilt gear 62 fits on top of and engages the pan gear 63. Both the tilt gear 62 and pan gear 63 rest upon and are supported by the wings 66W and square brackets 66B, which extend away from the pan and tilt track legs 66. As described above, operation of the pan and tilt assembly 50 is controlled by the pinion shaft 71. Rotating the pinion shaft 71 normally engages the pan gear 62 and changes the pan angle of the socket 45. Rotating the pinion shaft, while also depressing the pinion shaft 71, engages the tilt gear 63 and adjusts the tilt angle of the socket 45.

Figure 9:
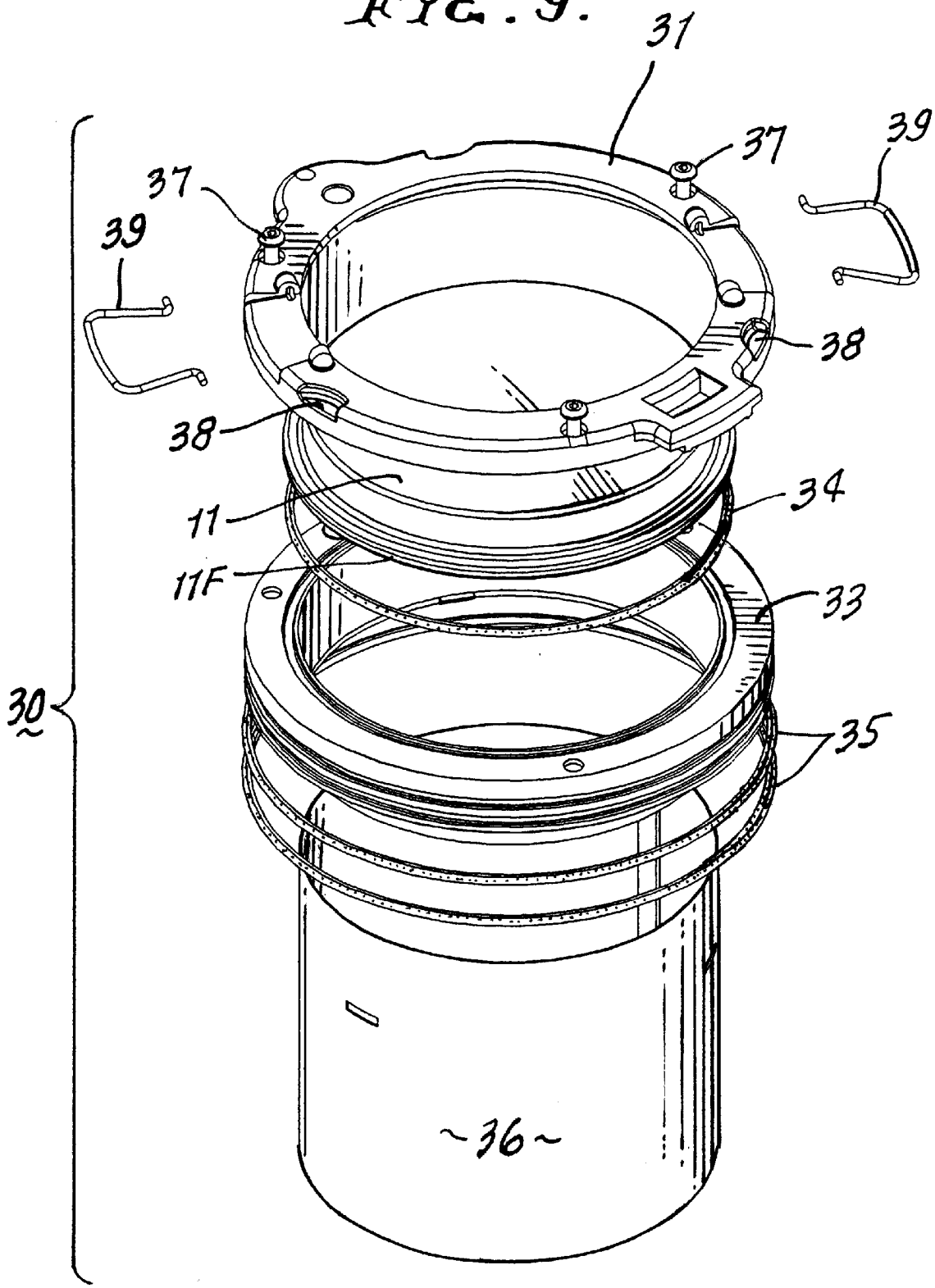
FIG. 9 is an exploded perspective view of the lens subassembly of the fixture of FIG. 2.
Figure 10:
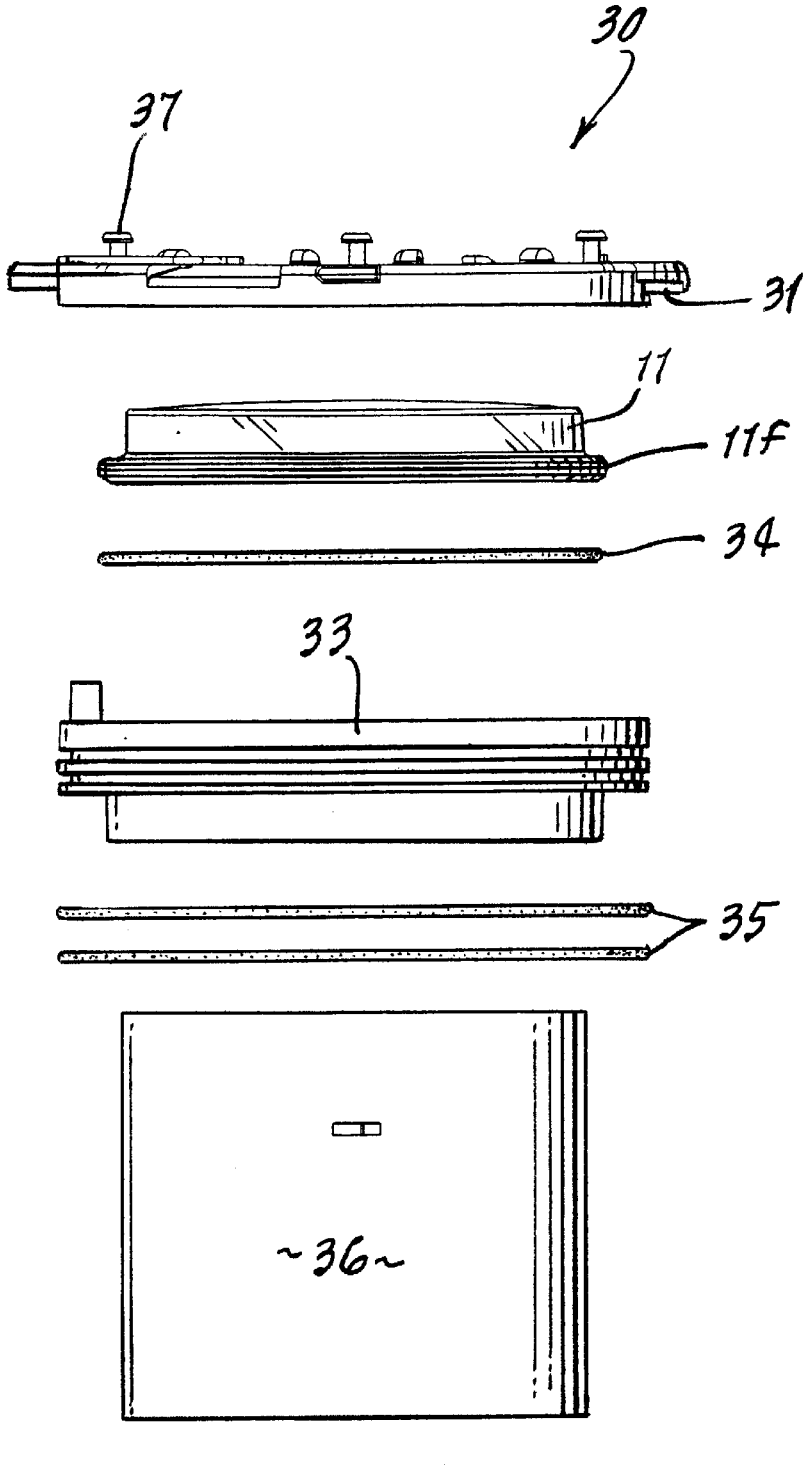
FIG. 10 is an exploded side elevational view of the lens subassembly of the fixture of FIG. 9.

FIGS. 9 and 10 illustrate the lens subassembly 30, comprised generally of a shield 36, lens mount 33, lens 11, and lens retainer 31. The lens subassembly 30 has a shield 36 which surrounds the pan and tilt subassembly 30 and pinion subassembly 70. The shield 36 is attached to the lens mount by screw fastener 37. Two O-rings 35 seal the lens mount 33 to the lamp housing 41. The lens 11 has a bottom portion of greater diameter 11F than the top portion of lens 11. The lens 11 is enclosed between and thereby attached to the lens mount 33 by way of the lens retainer 31, and three screws 37. An O-ring seals the union between the lens 11 F and the lens mount 33.

The top of the lens retainer has two lens handles 39, which lay flat against the surface of the lens retainer 31 when not in use. The lens handles 39 aid in removing the lens subassembly 30 or lamp subassembly 40.

The top of the lens retainer 31 has several slots 38, which are designed to engage the tabs 78 on the lamp housing 41 (FIG. 5). Depending upon which tabs are engaged, 78 or 79, the service or maintenance personnel may remove either the lens subassembly 30 alone or the lamp subassembly 40 including the lens subassembly 30. The ability to remove either the lens subassembly 30 or the lamp subassembly 40 provides a tertiary benefit wherein relamping can occur on site by simply removing the lens subassembly 30 or relamping can occur elsewhere by removing the entire lamp subassembly 40, which includes the lamp 40L (FIG. 3).

The lens subassembly 30 is completed by a trim ring 12, held in place on the lens retainer 31 by a single trim ring screw 14, as seen in FIG. 2. The trim ring is not only decorative but prevents unauthorized access to the pinion subassembly 70, which controls the pan and tilt. The top of the pinion shaft 71 is flush with the lens retainer 31. Removing the trim ring 12 exposes the top of the pinion shaft 71 which can be rotated to adjust the pan and tilt with a simple handheld tool, such as a screwdriver, as discussed earlier in conjunction with FIGS. 3, 4 and 5.

Figure 12:
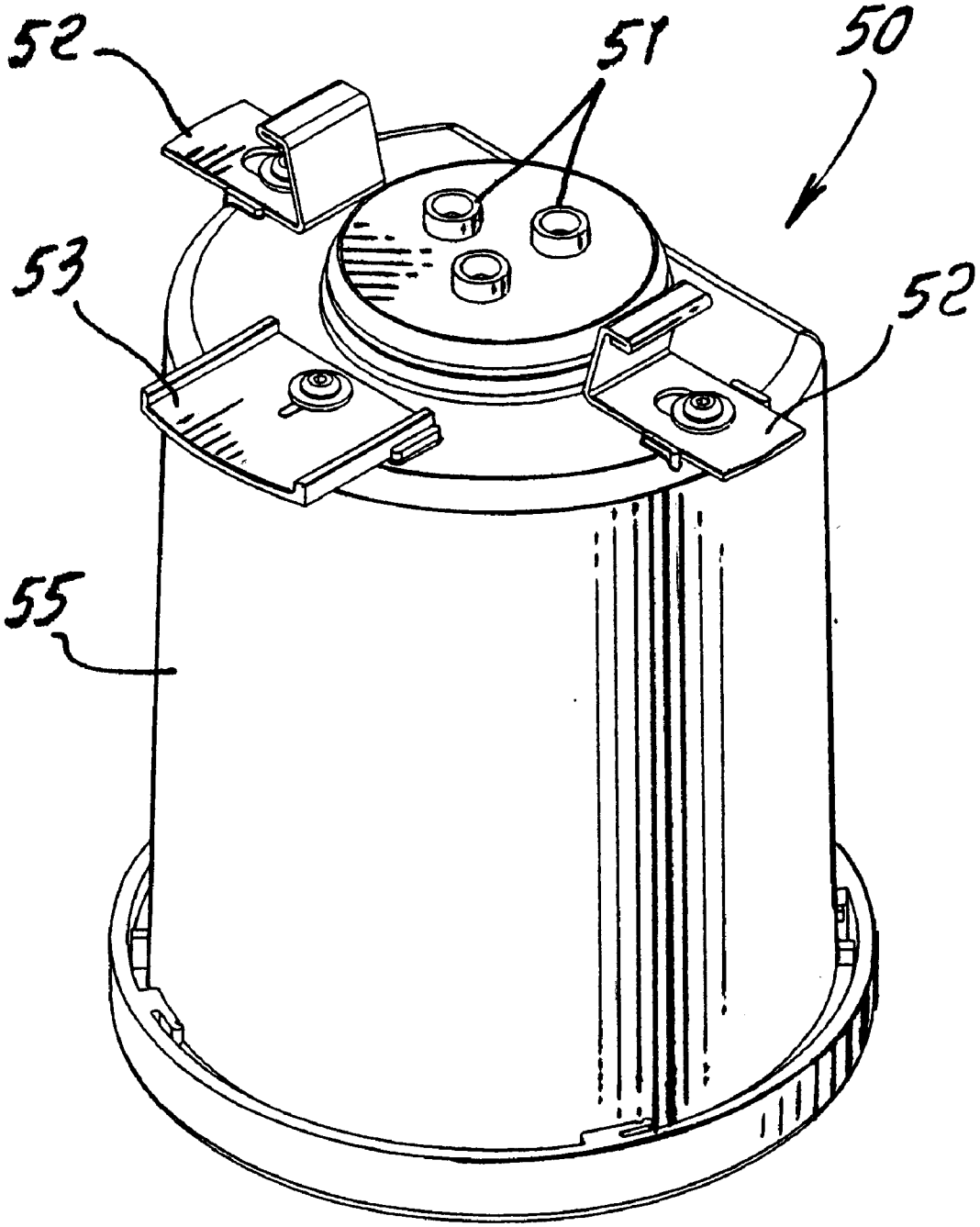
FIG. 12 is a perspective view of the ballast subassembly of the fixture of FIGS. 2 and 11.

FIGS. 11 and 12 illustrate the ballast subassembly 50, which is electrically connected to the lamp housing 41 by way of three plug-in electrical sockets 51 located on top of the ballast housing 55. The top of the ballast housing 55 also holds two ballast hooks 52, attached by screw, and one ballast tab 53, also attached by screw.

The ballast hooks 52 are slidably connected to the ballast housing 55. The base of the lamp housing 41 is configured to push the ballast hooks 52 outward and away from the ballast housing 55, to firmly engage the lower housing member 13*b*, when the two subassemblies are properly aligned. The ballast hooks 52, by engaging the lower housing member 13*b*, cause the ballast subassembly 50 to become secured within the lower housing member 13*b*, such that the ballast subassembly 50 is not removed when the lamp subassembly 40 is removed for relamping or repair.

The ballast tab 53 aids in the alignment of the ballast subassembly 50 with the lamp housing 41.

FIG. 13 illustrates.the two housing members 13*a* and 13*b*, which make up the exterior housing 13. The upper housing member 13*a* is joined with the lower housing member 13*b* by a screw wedge lock and bucket seal 13S to form a watertight compartment.

The upper housing member 13*a* has four tabs 13T, three of which appear in FIG. 13. As described above, the tabs aid in stabilizing the fixture on installation. Finally, FIG. 13 illustrates the manifold 16 of the upper housing member 13*a*, to which the wire box subassembly 20 is attached in a watertight fashion, better described in connection with FIGS. 14 and 15 below.

Figure 14:
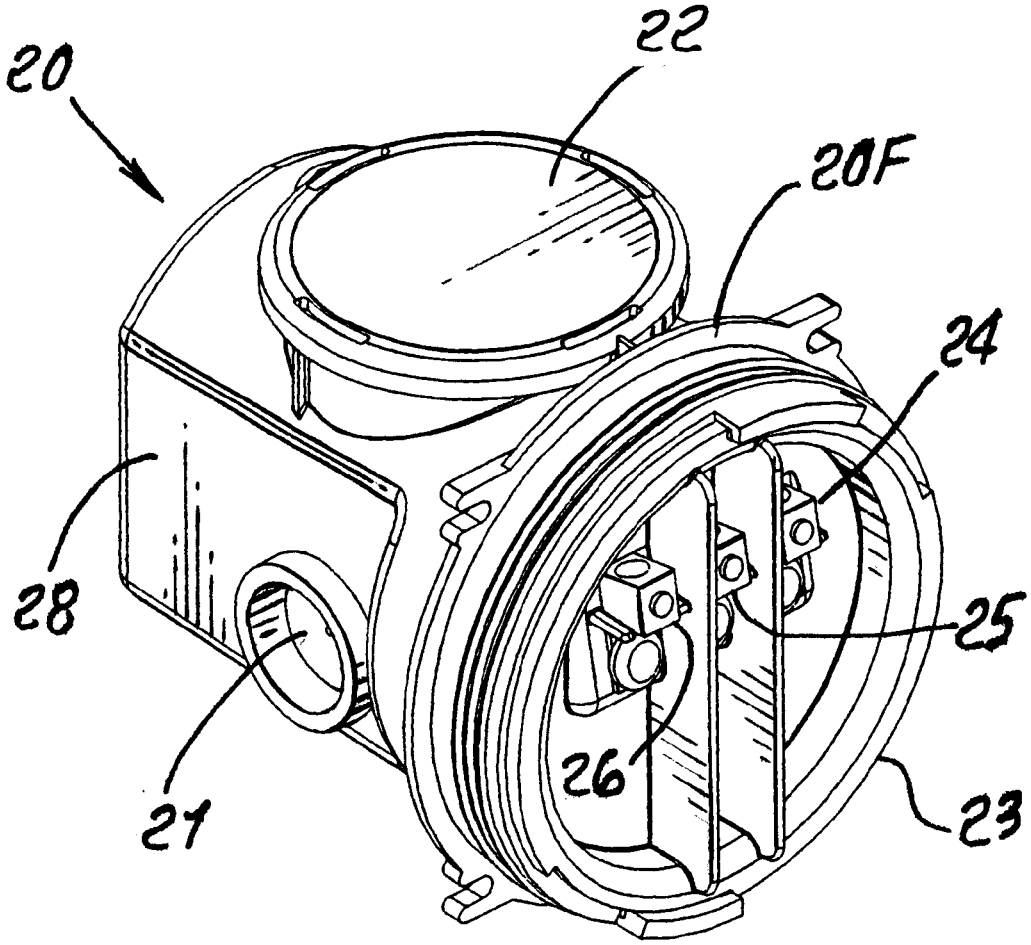
FIG. 14 is a perspective view of the wire box subassembly of the fixture of FIG. 1.
Figure 15:
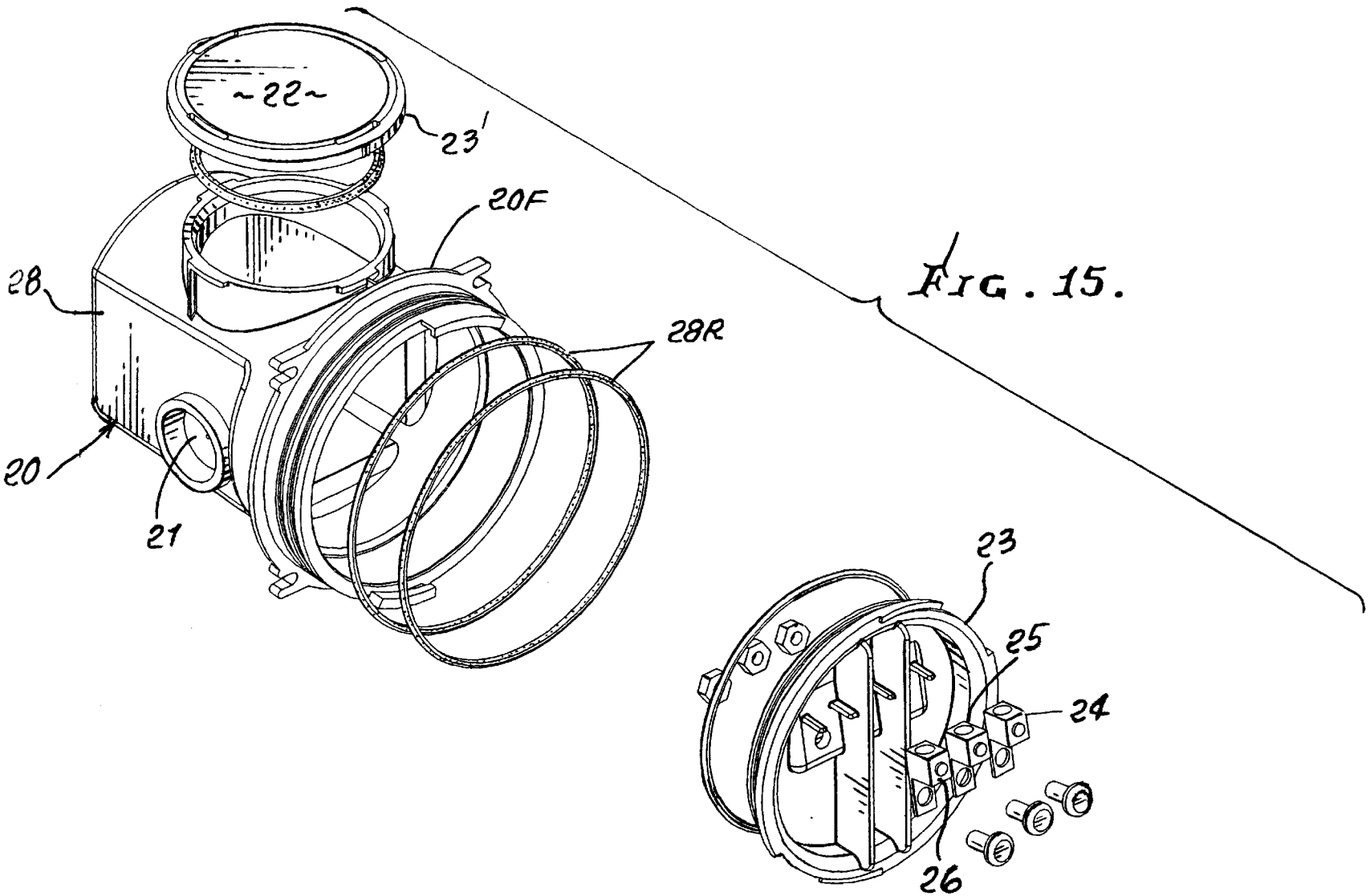
FIG. 15 is an exploded perspective view of the wire box subassembly of FIG. 14.

FIGS. 14 and 15 illustrate the wiring box subassembly 20. The wire box 28 may be made of LEXAN, described above, and is attached in a watertight manner to the upper housing member 13*a* at its flange 20F by a plurality of screws. Thus, any moisture or debris which may be introduced into the wiring box 28 is kept from entering the housing 13, where the lamp and electrical components are or will be located.

The wiring box 28 has a power-in receptacle 21, one inspection port 22, and several conduit entries having knock outs (not shown) for under or side access.

The power-in receptacle 21 is watertight as is the inspection port 22. The inspection port 22 has a cover 23 and is sealed by an O-ring or the like as seen in FIG. 15.

The separate waterproof wiring box 28 allows the installer entry into the wire box assembly 20 to perform all wiring activity without also having to access the main housing 13 and expose the fixture's components to the elements.

The wire box assembly 20 is large enough, with over 50 cubic inches in volume, to contain more than enough wire to meet the needs of any landscape designer or architect.

The wire box 28 has a cover 23 over the opening between the wire box 28 upper housing member 13*a*. The wire box cover 23, in the preferred embodiment, is threaded for easy removal and is designed to be received by the wire box 28, with two O-rings 28R completing the seal.

The wire box cover 23, opposite the wire box 28, has several terminal blocks, three of which 24, 25 and 26 are illustrated in FIGS. 14 and 15.

The wire box 28 also has an anti-siphon device.

A significant feature of this invention is that the wire box subassembly is separate and watertight from the exterior housing 13. The ballast subassembly 50 is also separately watertight from the exterior housing 13, and finally, the lamp subassembly 40, with lens subassembly 30 is separate and watertight from the exterior housing 13.

Because each subassembly is separate and watertight, maintenance and service personnel can perform work without exposing the components of the fixture of this invention to the elements when performing routine service, maintenance or lighting changes.

For installation, the empty housing 13 and wire box subassembly 20 may be installed and sealed with a dummy lens and trim ring. Wire may be pulled into the fixture's wire box 28 through the conduit opening 20, with access through inspection port 22, if available, or through manifold 16, if the housing is already mounted in permanent surface.

The ballast assembly 50, the lamp house assembly and lens assembly 30, may be installed whenever needed. Although each assembly is sealed from the other, each may be removed and serviced as required. Access to the sealed wire box 28 is available throughout the fixture's service life by opening the fixture 10, removing the lens subassembly 30, lamp house subassembly 40, and removing internal wire box cover 23 of FIG. 15.

The above-described embodiments of the present invention are merely descriptive of its principles and are not to be considered limiting. The scope of the present invention instead shall be determined from the scope of the following claims including their equivalents.

We claim:

1. A sub-surface light fixture comprising:

a fixture body, including a main housing, a ballast housing, a lamp housing, and an electrical housing;

said main housing being configured to receive said ballast housing and said lamp housing, and said electrical housing being attached to said main housing;

said housings being separately sealed and watertight relative to the outside and each other;

a lens;

a light source within said fixture body; and a pan and tilt mechanism within said fixture for variably controlling the position of the light emitted from said fixture.

2. A fixture in accordance with claim 1 wherein said electrical housing has a plurality of service ports with at least one port located between the main housing and the electrical housing, such that access into the electrical housing may be made from the main housing and at least one other port located on the electrical housing, such that access into the electrical housing may be made from outside the fixture.

3. A fixture in accordance with claim 1 wherein said main housing is configured to receive said lamp housing, and said lamp housing is configured to receive said lens such that said lens alone may be independently removed from said fixture for relamping or repair in the field or said lamp housing including said lens may be removed from said fixture for repair or relamping elsewhere.

4. A fixture in accordance with claim 1 wherein said ballast housing includes a plurality of hooks which selectively engage the inside surface of said main housing to secure said ballast housing in position.

5. A fixture in accordance with claim 1 wherein a light-emitting lens is secured to said upper housing member by means of a watertight seal.

6. A fixture in accordance with claim 1 wherein said ballast housing is contained within said main housing and includes a plurality of electrical connectors, said lamp housing includes a plurality of mating electrical connectors and said electrical connectors are joined to provide electrical connections between said lamp housing and said ballast housing.

7. A fixture in accordance with claim 2 wherein said electrical housing further includes a cover and seal, means closing a port between said main housing and said electrical housing, and terminal blocks providing electrical connections between the interior of said main housing and said electrical housing.

8. A fixture in accordance with claim 2 wherein one port in said electrical, housing is an access port for inspection or wiring.

9. A fixture in accordance with claim 1 wherein said pan and tilt mechanism is selectively driven by a single control member attached to said fixture.

10. A fixture in accordance with claim 9 wherein said control member is located adjacent to said lens within said lamp housing, said lamp housing being configured to be received by said main housing, said main housing is configured to receive a trim ring for enclosing and securing said lamp housing to said main housing such that removing said trim ring exposes and provides access to said lens or said lamp housing for relamping, repairs or removal, and exposes that portion of the pinion shaft which is manipulated to adjust the fixture's pan and tilt characteristics.

11. A fixture in accordance with claim 1 wherein said ballast housing is secured to said lower housing member.

12. A fixture in accordance with claim 1 wherein said main housing comprises an upper housing member and a lower housing member.

13. A fixture in accordance with claim 12 wherein said upper housing member includes a manifold and said electrical housing is connected to said manifold.

14. A fixture in accordance with claim 12 wherein said ballast housing is secured to said lower housing member.

15. A fixture in accordance with claim 12 wherein said lamp housing is secured to said upper housing member, a lamp is secured in said lamp housing, a pan and tilt mechanism is secured within said upper housing member, and a manually operated controller is provided for variably controlling the position of the light emitted from the fixture.

16. A fixture in accordance with claim 15 wherein said pan and tilt mechanism is selectively driven by a single control member attached to said fixture.

17. A fixture in accordance with claim 1 wherein said lens is configured to be received by and fit within said lamp housing; and a trim ring is provided for enclosing and securing said lamp housing to said main housing;

whereby removing said trim ring exposes and provides access to said lens or said lamp housing for relamping, repairs or removal and exposes a portion of said control member which is manipulated to adjust the pan and tilt characteristics of said fixture.

18. A fixture in accordance with claim 1 wherein said main housing and said electrical housing are separable and sealed to each other, whereby they may be installed separately or together in said subsurface location at one time and said ballast housing and said lamp housing are separable and sealed and may be installed in said main housing at a later time or said main housing, said ballast housing, said electrical housing and said lamp housing may be installed together at one time.

19. A fixture in accordance with claim 16 wherein said pan and tilt mechanism includes a pan gear, a tilt gear and said control member is a pinion shaft, said pinion shaft is attached to said fixture, said pinion shaft being biased to engage said pan gear, whereby rotating said pinion shaft controls the fixture's pan characteristic and longitudinally displacing said pinion shaft disengages and locks said pan gear while concurrently engaging said tilt gear, and rotating said pinion shaft controls the fixture's tilt characteristic and releasing said pinion shaft locks both said pan and said tilt gear.

20. A fixture in accordance with claim 19 wherein a spring positioned along said pinion shaft adjacent to said pan gear and said tilt gear acts to normally bias said pinion shaft to one of said gears.

21. A sub-surface light fixture comprising:

a main housing configured to receive a ballast housing, a lamp housing and an electrical housing, each housing being sealed and watertight from the elements and from each other;

a lens;

a light source within said fixture;

a pan and tilt mechanism coupled to said light source comprising a single pinion shaft, a pan gear and a tilt gear, whereby said pinion shaft serves to selectively drive said pan gear or said tilt gear to change the pan and tilt of said light source.

22. A fixture in accordance with claim 21 wherein said pinion shaft is biased to said pan gear such that rotating said pinion shaft controls the fixture's pan characteristic and moving said pinion shaft disengages said pan gear while concurrently engaging said tilt gear and rotating said depressed pinion shaft controls the fixture's tilt characteristic and releasing said pinion shaft prevents movement both said pan and said tilt gear.

23. A subsurface light fixture comprising:

a fixture body including a main housing, a ballast housing secured in said main housing, a lamp housing secured in said main housing, and an electrical housing;

said housings being separately sealed and watertight relative to the outside and each other;

a lens;

a light source within said lamp housing directed toward said lens; and a pan and tilt mechanism within said fixture for variably controlling the position of the light emitted from said fixture.

24. A fixture in accordance with claim 23 wherein said electrical housing has a plurality of service ports with at least one port located between the main housing and the electrical housing, such that access into the electrical housing may be made from the main housing and at least one other port located on the electrical housing, such that access into the electrical housing may be made from outside the fixture.

25. A fixture in accordance with claim 23 wherein said pan and tilt mechanism is selectively driven by a single control member attached to said fixture.

26. A fixture in accordance with claim 23 wherein said electrical housing further includes a cover and seal means closing a port between said main housing and said electrical housing, and terminal blocks providing electrical connections between the interior of said main housing and said electrical housing.

27. A fixture in accordance with claim 23 wherein said lens is configured to be received by and fit within said lamp housing; and a trim-ring is provided for enclosing and securing said lamp housing to said main housing;

whereby removing said trim ring exposes and provides access to said lens or said lamp housing for relamping, repairs or removal and exposes a portion of said control member which is manipulated to adjust the pan and tilt characteristics of said fixture.

28. A fixture in accordance with claim 23 wherein said main housing and said electrical housing may be installed together in said subsurface location at one time and said ballast housing and said lamp housing may be installed in said main housing at a later time or said main housing, said ballast housing, said electrical housing and said lamp housing may be installed together at one time.

29. A fixture in accordance with claim 23 wherein said main housing is configured to receive said lamp housing, and said lamp housing is configured to receive said lens such that said lens alone may be independently removed from said fixture for relamping or repair in the field or said lamp housing including said lens may be removed from said fixture for repair or relamping elsewhere.

* * * * *